United States Patent [19]

Powers

[11] Patent Number: 4,653,532

[45] Date of Patent: Mar. 31, 1987

[54] LOOP INJECTION CIRCULATION SYSTEM

[75] Inventor: Fredrick A. Powers, Maple Grove, Minn.

[73] Assignee: Graco Inc., Minneapolis, Minn.

[21] Appl. No.: 799,330

[22] Filed: Nov. 18, 1985

[51] Int. Cl.[4] ..... B05B 15/04

[52] U.S. Cl. ..... 137/563; 137/566; 137/567; 239/124

[58] Field of Search ..... 137/563, 566, 567; 239/124

[56] References Cited

U.S. PATENT DOCUMENTS

| | | | |
|---|---|---|---|
| 2,022,481 | 11/1935 | Schellenger | 137/563 X |
| 2,244,686 | 6/1941 | Garrison et al. | 137/563 X |
| 2,290,350 | 7/1942 | Olches | 299/58 |
| 2,599,680 | 6/1952 | Weeks | 299/58 |
| 2,638,973 | 5/1953 | Carey | 158/36.3 |
| 2,644,195 | 7/1953 | Bennes et al. | 137/563 X |
| 2,659,625 | 11/1953 | Gramatky | 299/46 |
| 3,111,942 | 11/1963 | Miller | 137/563 X |
| 3,233,651 | 2/1966 | Smith | 158/36.3 |
| 3,491,949 | 1/1970 | Hairston | 239/127 |
| 3,624,759 | 11/1971 | Carlson | 137/563 X |
| 4,199,303 | 4/1980 | Gusmer et al. | 417/216 |
| 4,390,126 | 6/1983 | Buchholz et al. | 137/563 X |
| 4,436,230 | 3/1984 | Hofmann | 222/614 |

*Primary Examiner*—Alan Cohan
*Assistant Examiner*—John A. Rivell

[57] ABSTRACT

A circulating system for dispensing fluid, such as paint, is provided with a circulating loop having a first pump. There is no substantial restriction in the circulating loop and a second pump injects additional fluid into the loop as needed to maintain pressure and make up for fluid which is dispensed by drops off of the circulating loop. Valving may be provided such that, either of the two pumps may function by itself in the event of a failure of one of the pumps.

6 Claims, 3 Drawing Figures

LOOP INJECTION CIRCULATION SYSTEM

BACKGROUND OF THE INVENTION

Circulating systems for pumping and dispensing fluid, such as paint, are well known and typically consist of a single pump drawing from a fluid source or reservoir. The pump output is connected to a circulating loop supply line having one or more drops off of the output of the pump for supplying spray guns or other dispensing devices. After the drops, the fluid is returned to the tank by way of a back-pressure regulator which serves to maintain the desired pressure in the supply line.

SUMMARY OF THE INVENTION

In the instant invention, a circulating loop pump is provided and is of a type which loads and discharges at the same rate. The loop circulating pump feeds a circulating loop which has one or more drops off of the loop for supplying fluid to a spray gun or other fluid-dispensing device. The circulating loop is constructed in such a manner that there is no back-pressure regulator or other fluid restricting device so that flow around the loop may be free and at substantially the same pressure all around.

A fluid injection pump is provided and has its inlet plumbed to a source or reservoir of supply fluid and its outlet attached to the circulating loop downstream from the circulating pump outlet and upstream from the spray gun drops. In such a system, the injection pump operates only as much as is necessary to replace fluid into the circulating loop which is used by the spray gun drops.

The energy saving with such an arrangement are quite substantial and can be as great as 60%. Because the back-pressure regulator is eliminated, the energy put into the fluid by the circulating pump is not wasted, but rather is retained in the circulating loop. Normally, in a conventional system, that energy would be lost through the back-pressure regulator.

In addition, the back-pressure regulator has recently been found to be a substantial source of paint degradation, particularly when utilized with metallic paints. The repeated passage of metallic particles through a back-pressure regulator can cause those particles to become damaged, thereby resulting in a color change.

When operating with both pumps in action, the cycle rate on each of those pumps is substantially reduced from that which either pump would operate at singly. This arrangement results in substantially increased pump life for each pump over its single-pump configuration life.

Further, with the addition of a few extra lines and simple valves, the system can be arranged so that, if either of the pumps were to fail, the other could serve a back-up function and the system could operate as a conventional one-pump system, rather than have the system go down.

These and other objects and advantages of the invention will appear more fully from the following description made in conjunction with the accompanying drawings wherein like reference characters refer to the same or similar parts throughout the several views.

A BRIEF DESCRIPTION OF THE DRAWINGS

DESCRIPTION OF THE PREFERRED EMBODIMENT

Figure 1:
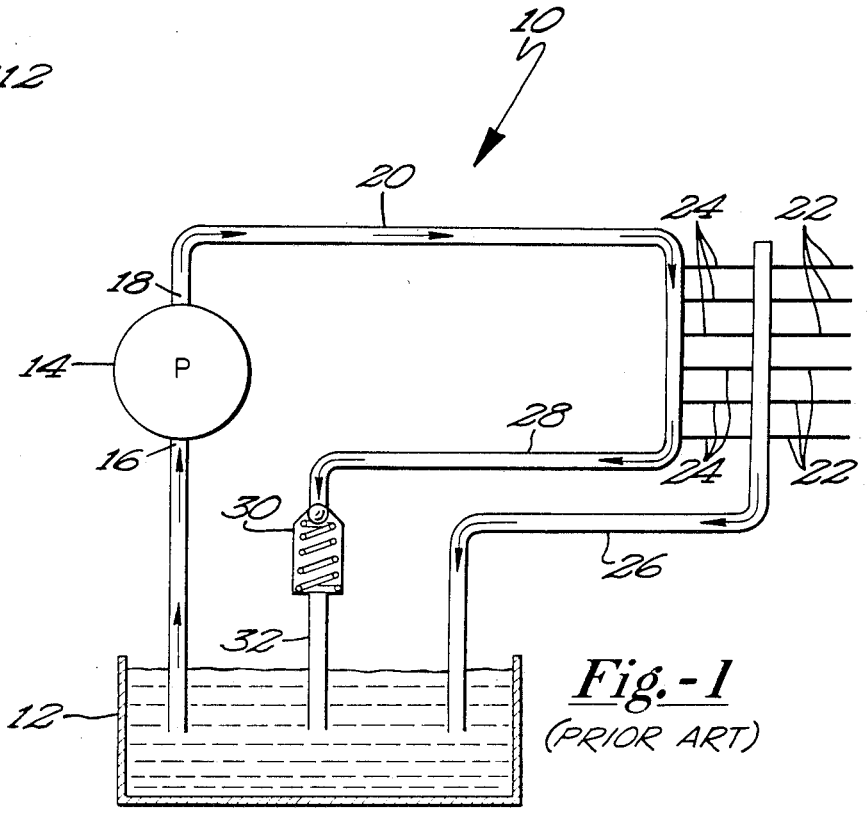
Fig.-1 (PRIOR ART)
FIG. 1 is a schematic view showing a prior art circulating system.

FIG. 1 displays a typical prior art circulating system, generally designated 10. The prior art system 10 consists generally of a reservoir or fluid source 12 which feeds a pump 14 having an inlet 16 and an outlet 18. Outlet 18 is connected to a supply line 20 which feeds a number of spray guns 22 or other fluid-dispensing devices by way of drops 24. A low pressure return line 26 may be included if the guns are of the type which circulate fluid through the gun even when the gun is not being used. A high pressure return line 28 leads from drops 24 to a back pressure regulator 30 which serves to maintain pressure in the system. In turn, a line 32 connects back pressure regulator 30 with reservoir 12. In such a system, energy is put into the fluid by pump 14 and that energy is then, in effect, lost as it passes through back pressure regulator 30 and into reservoir 12.

Figure 2:
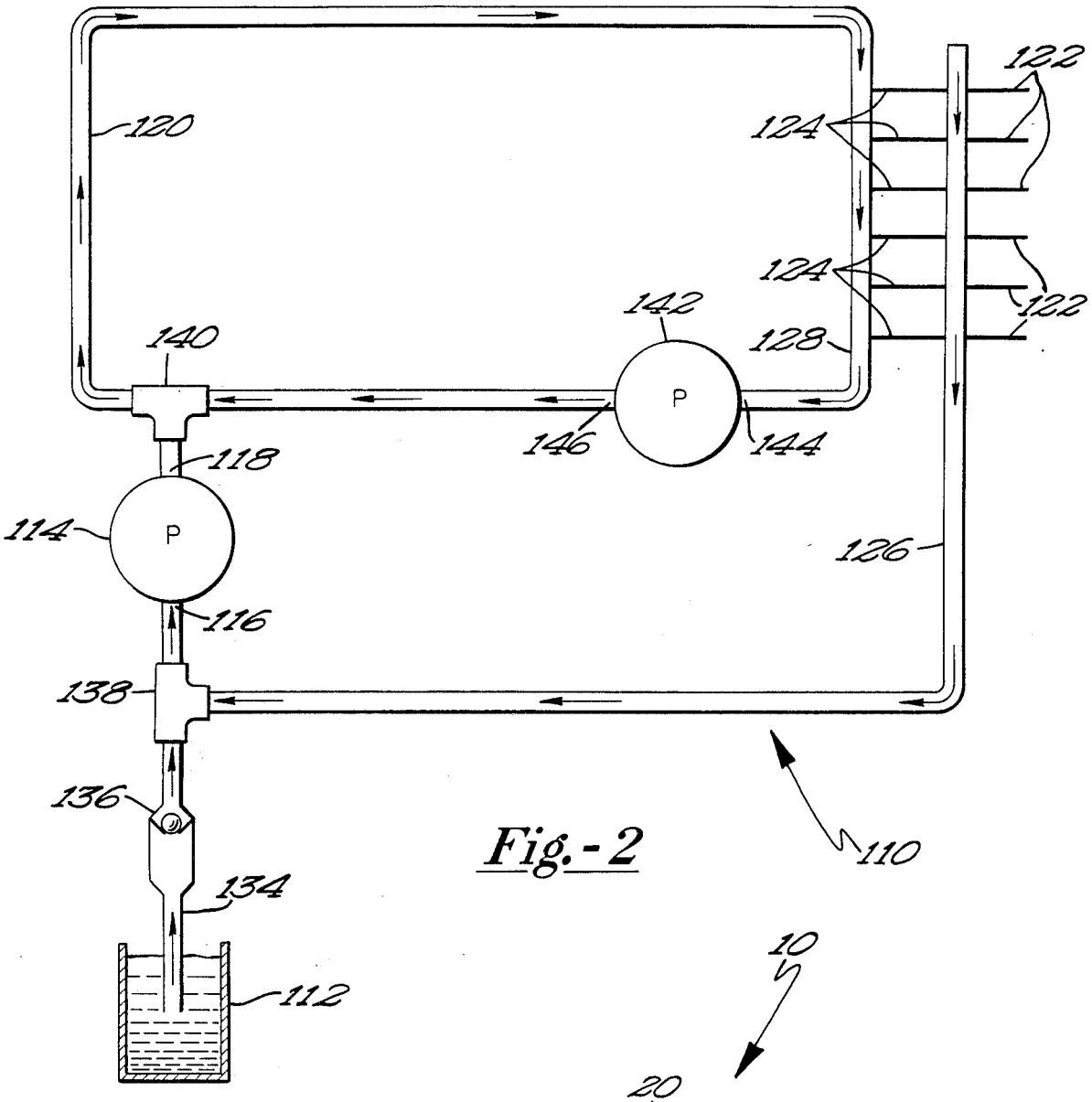
FIG. 2 is a schematic view showing the loop circulating system of the instant invention.

The loop injection circulating system 110 of the instant invention is shown generally and schematically in FIG. 2. A reservoir 112 has leading out of it an intake line 134 which is attached to a check valve 136, which allows flow only in the direction as shown by the arrows in FIG. 2. Check valve 136 is connected to a tee 138, which has one of its outlets connected to the intake 116 of injection pump 114. The outlet 118 of injection 114 is connected to a tee 140 in the circulating loop. Supply line 120 of the circulating loop is connected to tee 140 and provides fluid traveling in the direction shown by the arrows to drops 124, which service guns 122. Again, other fluid dispensing devices may be utilized depending on the system.

Similarly, a low pressure return line 126 takes fluid from guns 122 and returns them to previously mentioned tee 138. If desired, low pressure return line 126 may run directly to reservoir 112. If the plumbing is set up this way, check valve 136 and tee 138 may be deleted. A return line 128 leads from drops 124 to the inlet 144 of loop circulating pump 142. The outlet 146 of loop circulating pump 142 is connected to previously mentioned circulating tee 140. When there is no draw on the system, that is, when guns 122 are not being operated, injection pump 114 is essentially inactive and circulating pump 142 need work only very lightly to maintain pressure and circulation in the circulating loop. In a similar situation, the prior art system FIG. 1 would require pump 14 to continue to work against back pressure regulator 30 and expend a substantially greater amount of energy than the system of the instant invention shown in the FIG. 2.

Figure 3:
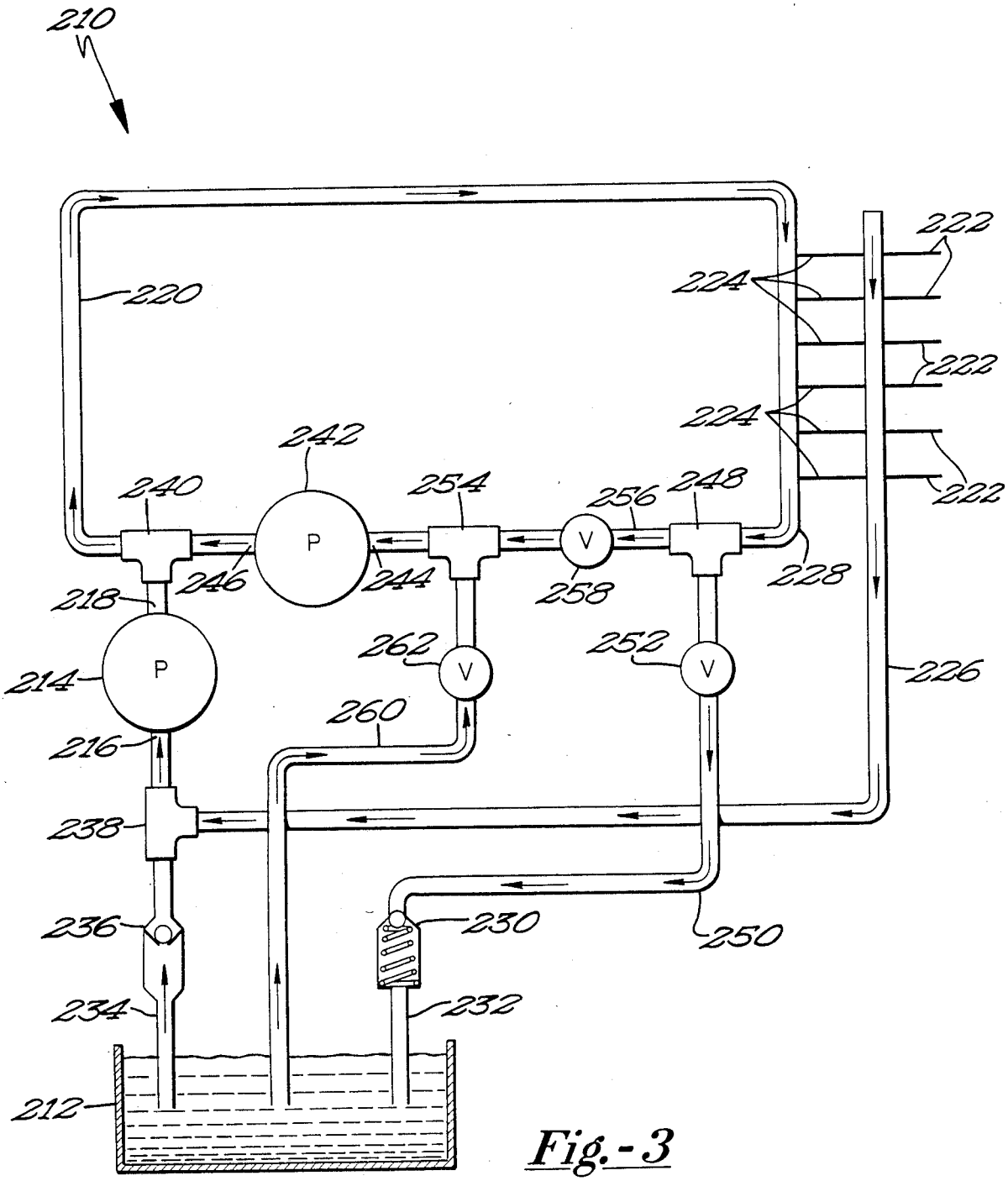
FIG. 3 is a schematic view of the instant invention showing additional plumbing necessary to provide a back-up pump capability.

Turning to FIG. 3, the back-up system 210 shown therein utilizes the invention as shown in FIG. 2 with extra plumbing so as to provide a back-up capability should either of the pumps fail.

A fluid reservoir 212 feeds an intake line 234 of check valve 236 which is, in turn, connected to a tee 238. The outlet of tee 238 is connected to the inlet 216 of injection pump 214. The outlet 218 of pump 214 is, in turn, connected to tee 240 which has at one outlet thereof a connection to supply line 220. Again, drops 224 are attached and connect to spray guns 222 which are, in turn, provided with a low pressure return line 226. Low pressure return line 226 is, in turn, connected to tee 238. Again, low pressure return line 226 may be directed to reservoir 212, thereby allowing the deletion of check valve 236 and tee 238. High pressure return line 228 from drops 224 is connected to tee 248 which has at one of its outlets a return line 250 having a valve 252 therein.

Return line 250 is connected to back pressure regulator 230 and a dump line 232. An intermediate line 256 connects tees 248 and 254 and has a valve 258 therein. Tee 254 has an auxiliary intake line 260 attached thereto which, in turn, has a valve 262 located therein. Tee 254 is, in turn, connected to intake 244 of loop circulating pump 242. The outlet 246 of circulating pump 242 is, in turn, connected to tee 240.

In practice, first valve 262, second valve 258 and third valve 252 are all simple on-off type valves. In normal operation of the system as described heretofore with reference to FIG. 2, first and third valves 262 and 252, respectively, are closed and second valve 258 opened.

Should injection pump 214 fail, first valve 262 would be opened, second valve 258 closed and third valve 252 opened to provide a back-up system which operates similar to the prior art system shown in FIG. 1. Flow in those lines having flow will be as shown by the arrows in FIG. 3.

Similarly, should circulating pump 242 fail, first and second valves 262 and 258, respectively, are closed and third valve 252 opened to, again, provide a back-up system which operates like the prior art system of FIG. 1.

It is contemplated that various changes and modifications may be made to the loop injection circulating system without departing from the spirit and scope of the invention as defined by the following claims.

What is claimed is:

1. A loop injection circulating system comprising:

a fluid source;

a high pressure circulating loop having at least one distribution outlet;

a circulating pump connected in series in said loop, said circulating pump comprising an inlet and an outlet; and an injection pump having an inlet and an outlet, said injection pump inlet being connected to said fluid source and said injection pump outlet being connected to said circulating loop;

a low pressure return line from said distribution outlet, said return line being connected to said injection pump inlet;

a check valve between said return line and said source allowing fluid to flow only out of said source.

2. The loop injection circulating system of claim 1 where said injection pump outlet is connected to said loop between said circulating pump outlet and said distribution outlet.

3. The loop injection circulating system of claim 1 wherein said circulating loop is free of any substantial restriction.

4. The loop injection circulating system of claim 1 wherein said circulating pump loads and unloads at equal rates.

5. A loop injection circulating system comprising:

a fluid source;

a high pressure circulating loop having at least one distribution outlet;

a circulating pump connected in series in said loop, said circulating pump comprising an inlet and an outlet;

an injection pump having an inlet and an outlet, said injection pump being connected to said circulating loop;

a first valve between said fluid source and said circulating pump inlet;

a second valve between said circulating pump inlet and said distribution outlet;

a back pressure regulator leading to said fluid source; and a third valve between said back-pressure regulator and a line connecting said second valve and said distribution outlet.

6. The loop injection circulating system of claim 5 where said injection pump outlet is connected to said loop between said circulating pump outlet and said distribution outlet.

* * * * *